US010348024B2

(12) United States Patent
Yonnet

(10) Patent No.: US 10,348,024 B2
(45) Date of Patent: Jul. 9, 2019

(54) ELECTRICAL PLUG AND SOCKET ASSEMBLY

(71) Applicant: GULPLUG, Grenoble (FR)

(72) Inventor: Jean-Paul Yonnet, Meylan (FR)

(73) Assignee: GULPLUG, Grenoble (FR)

( * ) Notice: Subject to any disclaimer, the term of this patent is extended or adjusted under 35 U.S.C. 154(b) by 0 days.

(21) Appl. No.: 15/740,946

(22) PCT Filed: Jun. 28, 2016

(86) PCT No.: PCT/FR2016/051585
§ 371 (c)(1),
(2) Date: Dec. 29, 2017

(87) PCT Pub. No.: WO2017/001755
PCT Pub. Date: Jan. 5, 2017

(65) Prior Publication Data

US 2018/0191097 A1 Jul. 5, 2018

(30) Foreign Application Priority Data

Jul. 1, 2015 (FR) ..... 15 56200

(51) Int. Cl.
*H01R 13/44* (2006.01)
*H01R 13/62* (2006.01)
*H01F 7/02* (2006.01)

(52) U.S. Cl.
CPC ..... *H01R 13/44* (2013.01); *H01R 13/6205* (2013.01); *H01F 7/02* (2013.01)

(58) Field of Classification Search
CPC ..... H01R 13/44; H01R 13/6205; H01F 7/02
USPC ..... 439/39
See application file for complete search history.

(56) References Cited

U.S. PATENT DOCUMENTS 3,521,216 A * 7/1970 Manuel ..... H01R 13/6205 439/152
3,808,577 A * 4/1974 Mathauser ..... H01R 13/6205 439/180
3,810,258 A * 5/1974 Mathauser ..... H01R 13/6205 439/246
7,066,739 B2 * 6/2006 McLeish ..... H01R 13/6205 439/39

(Continued)

FOREIGN PATENT DOCUMENTS

DE 19512335 8/1996
EP 2667459 11/2013

(Continued)

*Primary Examiner* — Alexander Gilman
(74) *Attorney, Agent, or Firm* — Occhiuti & Rohlicek LLP

(57) ABSTRACT

The invention relates to an electrical plug and socket assembly comprising: a base including at least two first electrical contacts and a first magnetic portion arranged so as to move by magnetic attraction to move the first two electrical contacts toward the outside of the base; a plug comprising two second electrical contacts intended to electrically connect to the first two electrical contacts when same are outside the base and a second magnetic portion to move, by magnetic attraction, the first magnetic portion to drive the first electrical contacts toward the outside of the base; the first magnetic portion or the second magnetic portion comprises at least one permanent magnet such as to form a magnetic circuit when the plug is brought near the base.

14 Claims, 9 Drawing Sheets

(56) References Cited

U.S. PATENT DOCUMENTS

| | | | | |
|---|---|---|---|---|
| 7,311,526 | B2 * | 12/2007 | Rohrbach | H01R 13/6205 439/39 |
| 7,329,128 | B1 * | 2/2008 | Awad | H01R 13/6205 439/38 |
| 8,608,502 | B2 * | 12/2013 | Witter | H01R 13/6205 439/335 |
| 8,702,437 | B2 * | 4/2014 | Fullerton | H01R 13/6205 439/236 |
| 9,300,081 | B2 * | 3/2016 | Rudisill | H01R 13/6205 |
| 9,620,893 | B2 * | 4/2017 | Kim | H01R 13/6205 |
| 9,660,378 | B2 * | 5/2017 | Silvers | H01R 13/6205 |
| 10,008,817 | B2 * | 6/2018 | Fullerton | H01R 31/065 |
| 2007/0254510 | A1 * | 11/2007 | Debey | H01R 13/6205 439/188 |
| 2011/0171837 | A1 * | 7/2011 | Hardisty | H01R 13/6205 439/39 |
| 2013/0210244 | A1 * | 8/2013 | DiFonzo | H01R 13/6205 439/39 |

FOREIGN PATENT DOCUMENTS

| | | |
|---|---|---|
| FR | 3012263 | 4/2015 |
| WO | 2012/032230 | 3/2012 |

* cited by examiner

ELECTRICAL PLUG AND SOCKET ASSEMBLY

CROSS REFERENCE TO RELATED APPLICATION

This application is the national phase under 35 USC 371 of international application no. PCT/FR2016/051585, filed Jun. 28, 2016, which claims the benefit of the Jul. 1, 2015 priority date of French application no. 1556200.

TECHNICAL FIELD OF THE INVENTION

The present invention pertains to an electrical connector assembly. The electrical connector assembly comprises a socket and an electrical plug intended to be fitted on the socket. The association of the plug and of the socket is achieved by magnetic effect.

PRIOR ART

Patent application WO2012032230A1 describes an electrical connector assembly comprising a socket and an electrical plug intended to fit on the socket. The plug comprises two electrical tracks intended to connect electrically to two electrical contacts of the socket. The two electrical contacts exhibit the particularity of moving between a retracted position inside the socket and a position outside the socket so as to prevent any access to the contacts when the appliance to be connected is not employed. When the plug is brought closer to the socket, magnetic control means, comprising a permanent magnet integrated into the plug and a mobile magnetic element housed in the socket and integral with the electrical contacts, allow the extraction of the electrical contacts from the socket. The magnetic element and the permanent magnet are both of annular shape and face one another in such a way as to generate a circular air-gap between them. In this solution, the lines of the magnetic field created by the permanent magnet are concentrated in the air-gap but loop back in the air so as to meet the opposite face of the permanent magnet, rendering the magnetic solution rather ineffective.

Patent application EP2667459A1 also describes an electrical connector assembly comprising a socket and an electrical plug intended to fit on the socket. This document describes an improved magnetic architecture for the extraction of the electrical contacts. This architecture is based on the creation of a magnetic circuit between the plug and the socket and comprises a magnetic yoke formed of a first part housed in the plug and of a second part housed in the socket. When the plug is distant from the socket, the lines of the magnetic field created by the permanent magnet present in the plug tend to loop back in the magnetic circuit of the plug. Thus, when the plug is brought closer to the socket, the magnetic effect will be attenuated and the amount of magnet to be used to carry out the extraction of the electrical contacts will have to be more significant. Moreover, in addition to a concern over magnetic effectiveness, this architecture comprises two other drawbacks:

- The presence of three distinct air-gaps, rendering it more complex and causing it to generate more numerous magnetic leaks,
- The presence of the magnetic yoke outside gives rise to significant bulk.

Patent application FR3012263A1 describes yet another architecture of an electrical connector assembly which exhibits drawbacks similar to those of the solution of application EP2667459A1. In particular, the proposed solution defines two distinct air-gaps, possibly leading to more numerous magnetic leaks.

The aim of the invention is to propose an electrical connector assembly which is simple, reliable, not very bulky and which comprises a socket and an electrical plug in which the amount of magnet to be used to carry out the extraction of the electrical contacts is reduced with respect to the solutions of the prior art. The solution of the invention makes it possible in particular to better confine the magnetic field between the two parts of the assembly of the invention.

DISCLOSURE OF THE INVENTION

This aim is achieved by an electrical connector assembly comprising:

- a socket comprising at least one first electrical contact, a first magnetic part integral in motion with the two first electrical contacts, said first magnetic part being arranged to move by magnetic effect between a first position in which the first electrical contact is retracted inside the socket and a second position in which the first electrical contact is outside the socket,
- a plug intended to fit on the socket and comprising at least one second electrical contact intended to connect electrically to the first electrical contact when the latter is outside the socket and a second magnetic part arranged opposite the first magnetic part when the plug is fitted on the socket so as to displace, by magnetic effect, the first magnetic part toward its second position, driving the first electrical contact outward from the socket,
- the first magnetic part or the second magnetic part comprising at least one permanent magnet in such a way as to form a magnetic circuit when the plug is brought closer to the socket,
- the first magnetic part comprising a first air-gap surface and a second air-gap surface and a first ferromagnetic piece fixed on the one hand on a surface opposite to its first air-gap surface and on the other hand on a surface opposite to its second air-gap surface,
- the second magnetic part comprising a first air-gap surface intended to be opposite the first air-gap surface of the first magnetic part so as to form a first air-gap, a second air-gap surface intended to be opposite the second air-gap surface of the first magnetic part so as to form a second air-gap when the plug is brought closer to the socket and a second ferromagnetic piece fixed on the one hand on a surface opposite to its first air-gap surface and on the other hand on a surface opposite to its second air-gap surface,
- said magnetic circuit being formed between the first magnetic part and the second magnetic part so as to generate a magnetic flux passing through the first air-gap and through the second air-gap.

According to one particularity, the first ferromagnetic piece exhibits a loop-shaped architecture arranged parallel to the junction plane and in that the second ferromagnetic piece exhibits an architecture identical to that of the first ferromagnetic piece.

According to another particularity, the first ferromagnetic piece is of annular shape and arranged parallel to the junction plane and in that the second ferromagnetic piece is of annular shape arranged parallel to the junction plane.

In a first configuration, the permanent magnet is for example fixed on a first annular portion of the second ferromagnetic piece, forming the first air-gap surface of the second magnetic part.

According to a first architecture related to the first configuration, the assembly comprises:

an element made of ferromagnetic material fixed on a second annular portion, symmetrically with the permanent magnet, in such a way as to form the second air-gap surface of the second magnetic part, two elements made of ferromagnetic material fixed symmetrically on two annular portions of the first ferromagnetic piece, forming the first air-gap surface and the second air-gap surface of the first magnetic part.

According to a second architecture related to the first configuration, the assembly comprises:

a permanent magnet fixed on a second annular portion of the second ferromagnetic piece, forming the second air-gap surface of the second magnetic part, two elements made of ferromagnetic material fixed symmetrically on two annular portions of the first ferromagnetic piece, forming the first air-gap surface and the second air-gap surface of the first magnetic part.

According to a third architecture related to the first configuration, the assembly comprises:

a permanent magnet fixed on a second annular portion of the second ferromagnetic piece, forming the second air-gap surface of the second magnetic part, two permanent magnets fixed symmetrically on two annular portions of the first ferromagnetic piece, forming the first air-gap surface and the second air-gap surface of the first magnetic part.

According to a fourth architecture related to the first configuration, the assembly comprises:

an element made of ferromagnetic material fixed on a second annular portion, symmetrically with the permanent magnet, in such a way as to form the second air-gap surface of the second magnetic part, a permanent magnet fixed on a first annular portion of the first ferromagnetic piece forming the first air-gap surface of the first magnetic part, an element made of ferromagnetic material fixed on a second annular portion of the first ferromagnetic piece, symmetrically with the permanent magnet, in such a way as to form the second air-gap surface of the first magnetic part.

According to a second configuration, the permanent magnet is for example fixed on a first annular portion of the first ferromagnetic piece, forming the first air-gap surface of the first magnetic part.

According to a first architecture related to the second configuration, the assembly comprises:

an element made of ferromagnetic material fixed on a second annular portion of the first ferromagnetic piece, symmetrically with the permanent magnet, in such a way as to form the second air-gap surface of the first magnetic part, two elements made of ferromagnetic material fixed symmetrically on two annular portions of the second ferromagnetic piece, forming the first air-gap surface and the second air-gap surface of the second magnetic part.

According to a second architecture related to the second configuration, the assembly:

a permanent magnet fixed on a second annular portion of the first ferromagnetic piece, forming the second air-gap surface of the first magnetic part, two elements made of ferromagnetic material fixed symmetrically on two annular portions of the second ferromagnetic piece, forming the first air-gap surface and the second air-gap surface of the second magnetic part.

According to a third architecture related to the second configuration, the assembly comprises:

a permanent magnet fixed on a second annular portion of the first ferromagnetic piece, forming the second air-gap surface of the first magnetic part, two permanent magnets fixed symmetrically on two annular portions of the second ferromagnetic piece, forming the first air-gap surface and the second air-gap surface of the second magnetic part.

According to another particularity of the invention, the plug comprises a casing and the second magnetic part is arranged to rotate freely inside the casing.

According to another particularity of the invention, the first magnetic part and the second magnetic part are arranged in such a way that the magnetic circuit generates a magnetic flux surrounding the first electrical contacts and the second electrical contacts.

BRIEF DESCRIPTION OF THE FIGURES

Other characteristics and advantages will become apparent in the following detailed description given with regard to the appended drawings in which:

In FIGS. 1A to 4B, it must be understood that the magnetic parts 13, 23 are viewed by an observer placed between the socket and the plug.

Figure 1A:
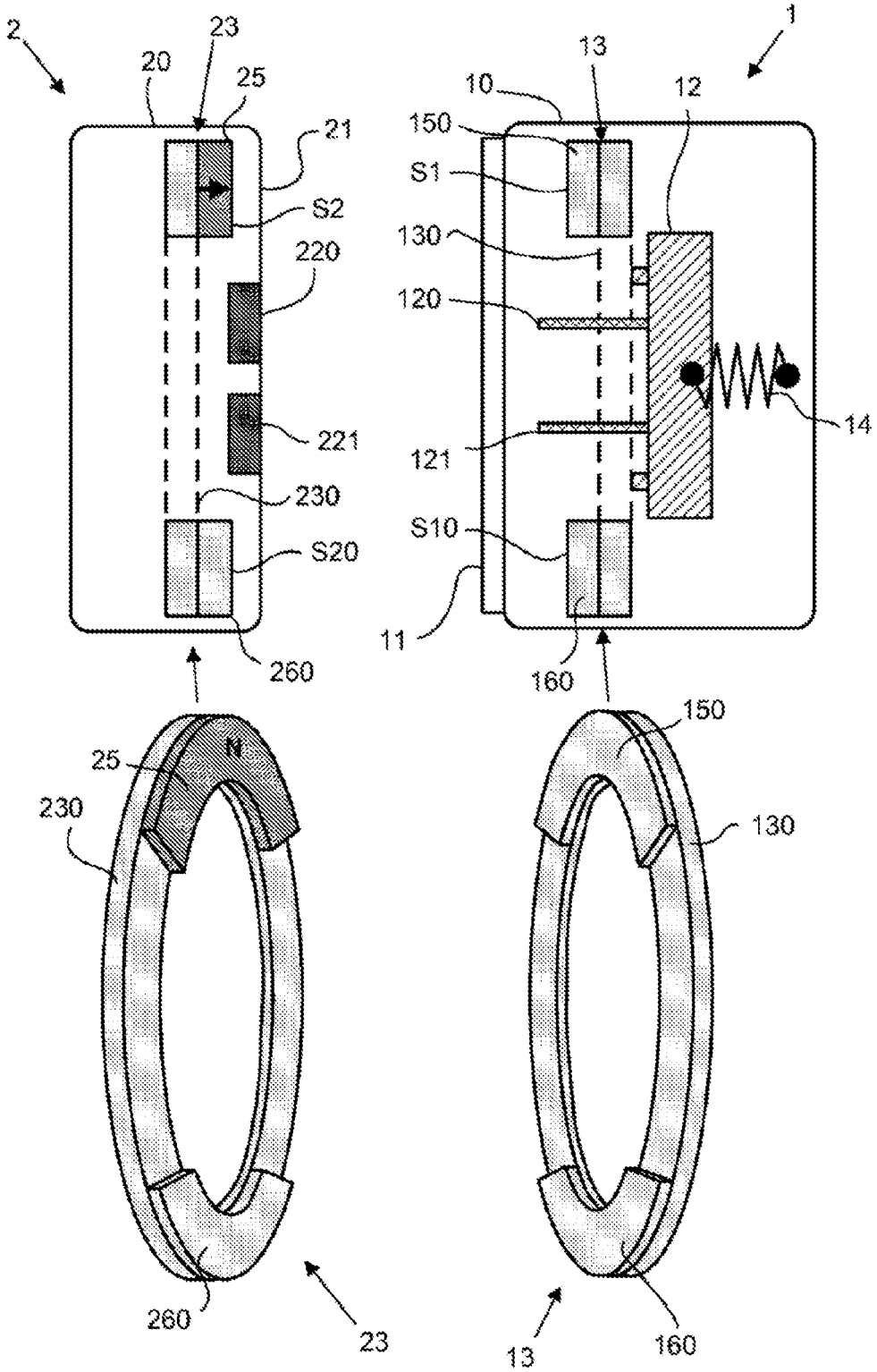
FIGS. 1A and 1B represent a first architecture of the electrical connector assembly of the invention, comprising a socket and a plug respectively uncoupled and coupled.

In the appended figures, the letter N designates the North pole of the magnet and the letter S designates the South pole of the magnet.

DETAILED DESCRIPTION OF AT LEAST ONE EMBODIMENT

With reference to the appended figures, the electrical connector assembly of the invention comprises a socket 1 and an electrical plug 2 intended to fit on the socket 1.

The socket 1 comprises a plastic casing 10 intended for example to be embedded in a wall. The socket 1 exhibits a front face 11 against which the electrical plug can be fitted. The socket also comprises a mobile support 12 on which two first electrical contacts 120, 121 are fixed. The two first electrical contacts 120, 121 are linked to an electrical voltage source by way of conducting electrical wires (not represented in the figures). The socket 1 also comprises a first mobile magnetic part 13 integral in motion with the mobile support 12 and arranged so as to move by magnetic effect between a first position and a second position. A spring 14 positioned inside the casing 10 of the socket, for example fixed on the one hand to the casing 10 of the socket and on the other hand to the mobile support 12, is arranged so as to restore the first magnetic part 13 to its first position when the magnetic effect necessary for extraction is no longer significant enough. In the first position of the first magnetic part 13, the first electrical contacts 120, 121 are retracted inside the socket 1 and in the second position of the first magnetic part 13, the first electrical contacts 120, 121 are outside the socket 1, passing through its front face 11. In its second position, the mobile assembly formed by the support 12 and the magnetic part 13 comes into abutment, for example against a part of the casing 10.

The electrical plug 2 comprises in fact a plastic casing 20, exhibiting a front face 21 intended to bear against the front face 11 of the socket 1, defining a junction plane P (defined vertically in the appended figures) between the socket 1 and the plug 2. The plug 2 furthermore comprises two second electrical contacts 220, 221, for example two electrical tracks flush with its front face 21, intended to come into electrical contact with the two first electrical contacts 120, 121 of the socket 1. It also comprises a second magnetic part 23 intended to attract the first magnetic part 13 when the plug 2 is brought closer to the socket 1 so as to extract the first electrical contacts 120, 121. Preferentially, the two electrical tracks are of circular shape and positioned in a concentric manner.

The invention aims to create a magnetic circuit making it possible to provide a sufficiently significant magnetic force counter to the force exerted by the spring 14, in order to extract the electrical contacts 120, 121 from the socket 1.

The magnetic circuit is generated between the two magnetic parts 13, 23 when the plug 2 is brought sufficiently close to the socket 1.

The two magnetic parts 13, 23 are formed and arranged in such a way that the magnetic circuit is generated around the first electrical contacts 120, 121 and second electrical contacts 220, 221 when the latter are connected.

The first magnetic part 13 exhibits a first air-gap surface S1, a second air-gap surface S10 and a first ferromagnetic piece 130 fixed on the one hand on a surface opposite to its first air-gap surface S1 and on the other hand on a surface opposite to its second air-gap surface S10.

The second magnetic part 23 comprises a first air-gap surface S2 intended to be opposite the first air-gap surface S1 of the first magnetic part 13 so as to create a first air-gap and a second air-gap surface S20 intended to be opposite the second air-gap surface S10 of the first magnetic part 13 so as to create a second air-gap when the plug 2 is brought closer to the socket 1. The second magnetic part 23 also comprises a second ferromagnetic piece 230 fixed on the one hand on a surface opposite to its first air-gap surface S2 and on the other hand on a surface opposite to its second air-gap surface S20.

In each magnetic part 13, 23, the two ferromagnetic pieces 130, 230 make it possible to channel the magnetic flux between the two air-gap surfaces when the plug is brought closer to the socket.

The magnetic circuit is generated such that, even when the first magnetic part 13 is still in its first position, the first magnetic part 13 and the second magnetic part 23 are arranged in such a way as to favor the passage of a magnetic flux $\varphi$ across the first air-gap and the second air-gap rather than between the two air-gap surfaces S1, S10 (or S2, S20) of one and the same magnetic part 13 (or 23). Stated otherwise, in each magnetic part 13, 23, the air-gap surfaces are positioned in such a way as to avoid any loopback of the lines of the magnetic field between these two surfaces.

More precisely:

The first ferromagnetic piece 130 is preferentially of annular shape and arranged inside the socket 1 so that its axis of revolution is perpendicular to its front face 11.

The second ferromagnetic piece 230 is preferentially of annular shape and positioned inside the plug 2 so that its axis of revolution is perpendicular to its front face 21.

The two annular ferromagnetic pieces 130, 230 are positioned in a coaxial manner so as to allow a rotation of the plug 2 with respect to the socket 1, rendering the angular positioning of the plug 2 independent with respect to the socket 1. This advantage is allowed only if the electrical tracks of the plug 2 are circular and positioned in a concentric manner.

Advantageously, the second magnetic part 23 is arranged inside the casing 20 of the plug in such a way as to be able to rotate freely inside the casing 20 so as to orient itself with respect to the first magnetic part 13.

According to the architectures, the two ferromagnetic pieces 130, 230 can be of identical or non-identical sizes.

Advantageously, the two ferromagnetic pieces of annular shape are of constant thickness over their entire circumference.

Each ferromagnetic piece 130, 230 of annular shape comprises a first annular portion spreading over a first angular span and a second annular portion spreading over a second angular span. The two annular portions are distinct and for example positioned symmetrically with respect to a transverse plane of symmetry of the ferromagnetic piece. Preferentially, each annular portion occupies an angular span of less than 180° and for example about equal to 120°.

According to the architectures, each annular portion is overlaid with a permanent magnet 15, 16, 25, 26 and/or with an element made of ferromagnetic material 150, 160, 260 as a thickening with respect to the thickness of the annulus formed by the ferromagnetic piece. The permanent magnet or the element made of ferromagnetic material is intended to each form an air-gap surface of the magnetic part 13, 23, such as defined hereinabove.

In all the architectures, the assembly comprises at least one permanent magnet fixed on an annular portion of the first ferromagnetic piece 130 or of the second ferromagnetic piece 230 in such a way as to generate the magnetic circuit.

Each permanent magnet is produced in the form of a portion of annulus intended to overlay an annular portion of the ferromagnetic piece on which it is fixed. It is arranged in such a way as to exhibit a first pole face against the ferromagnetic piece and a second pole face oriented toward the front face 11, 21 of the plug or of the socket. The orientation of the pole faces of the permanent magnet determines the sense of the magnetic flux co generated in the magnetic circuit.

With reference to the appended figures, several architectures are thereafter possible for creating the magnetic circuit defined hereinabove. In all these architectures, it must be understood that each permanent magnet employed can be fixed on the first ferromagnetic piece 130 or on the second ferromagnetic piece 230.

Figure 1B:
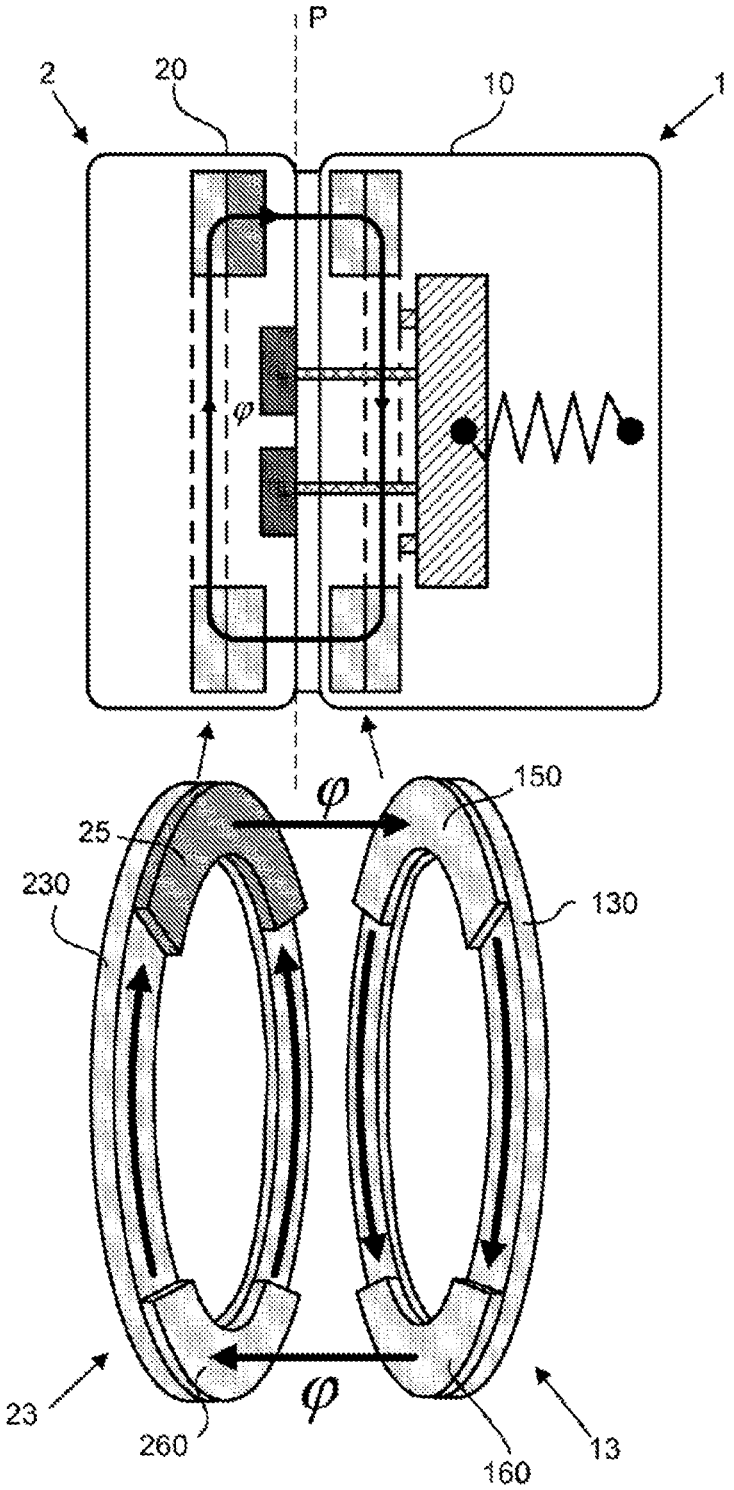

First Architecture—FIGS. 1A and 1B

In a first architecture, the magnetic circuit comprises only a single permanent magnet 25. In FIGS. 1A and 1B, the permanent magnet 25 is fixed on the first annular portion of the second ferromagnetic piece 230. Its second pole face corresponds to the first air-gap surface S2 of the second magnetic part 23. The second air-gap surface S20 of the second magnetic part 23 is formed by an element made of ferromagnetic material 260 fixed on the second ferromagnetic piece 230 on the second annular portion of the second ferromagnetic piece 230.

In this first architecture, the first air-gap surface S1 and the second air-gap surface S10 of the first magnetic part 13 are both formed by elements made of ferromagnetic material 150, 160 each fixed on the two distinct annular portions of the first ferromagnetic piece 130.

The permanent magnet 25 and each magnetic element are positioned in such a way as to generate the air-gaps defined hereinabove when the plug is brought closer to the socket.

The magnetic flux co generated by the permanent magnet 25 passes through the permanent magnet between these two pole faces and then circulates across the first air-gap to the element 150, and then in parallel and in the same sense across the two lateral portions of the first ferromagnetic piece 130 so as to meet the element 160, the second air-gap surface S10 of the first magnetic part, and then passes through the second air-gap so as to meet the element 260, before meeting the first pole face of the permanent magnet 25 by passing in parallel and in the same sense through the two lateral portions of the second ferromagnetic piece 230.

In this first architecture, the two annular ferromagnetic pieces 130, 230 are not necessarily identical.

Figure 2A:
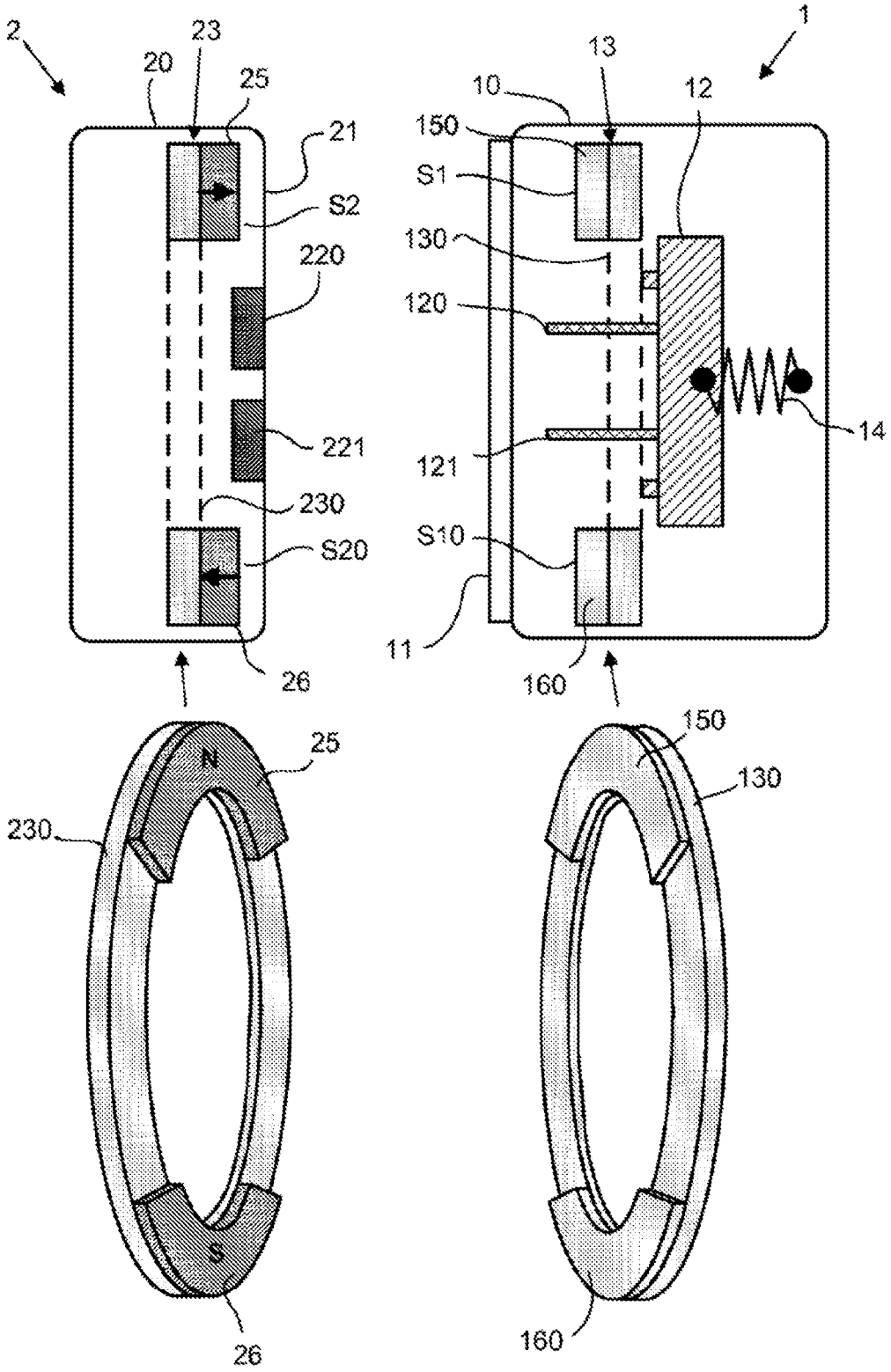
FIGS. 2A and 2B represent a second architecture of the electrical connector assembly of the invention, comprising a socket and a plug respectively uncoupled and coupled.
Figure 2B:
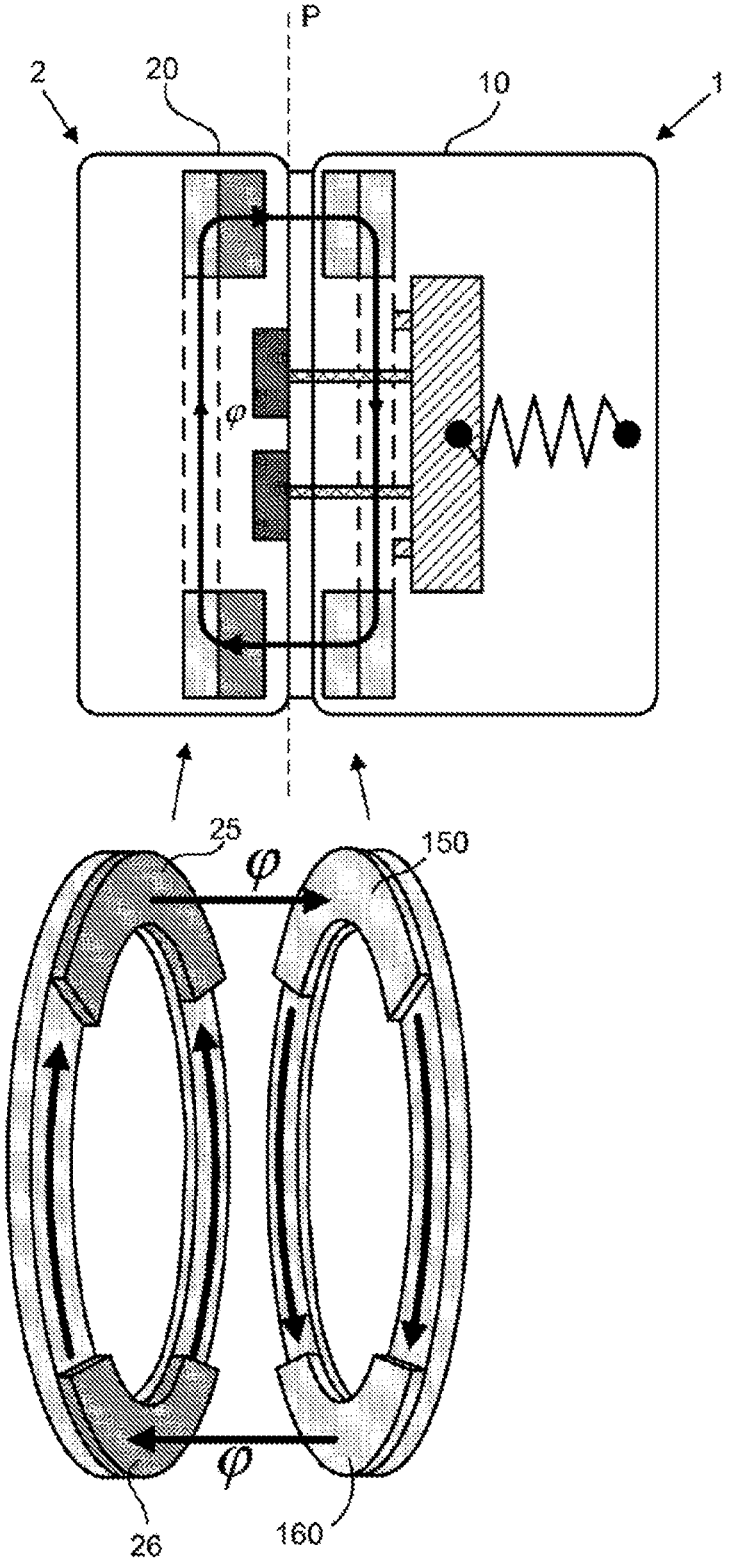

Second Architecture—FIGS. 2A and 2B

In this architecture, with respect to the first architecture, a second permanent magnet 26 is fixed on the second ferromagnetic piece 230, as replacement for its magnetic element 260. The second permanent magnet 26 is fixed in such a way that its pole faces are oriented inversely to those of the first permanent magnet 25 so as to favor the magnetic flux co in the magnetic circuit.

With respect to the first architecture, by virtue of its two permanent magnets 25, 26 positioned symmetrically with respect to the axes of revolution of the two annular pieces, this second architecture exhibits the advantage of balancing the magnetic force exerted when the plug is brought closer to the socket.

In this architecture, the magnetic flux generated follows the same path as in the first architecture.

Figure 3A:
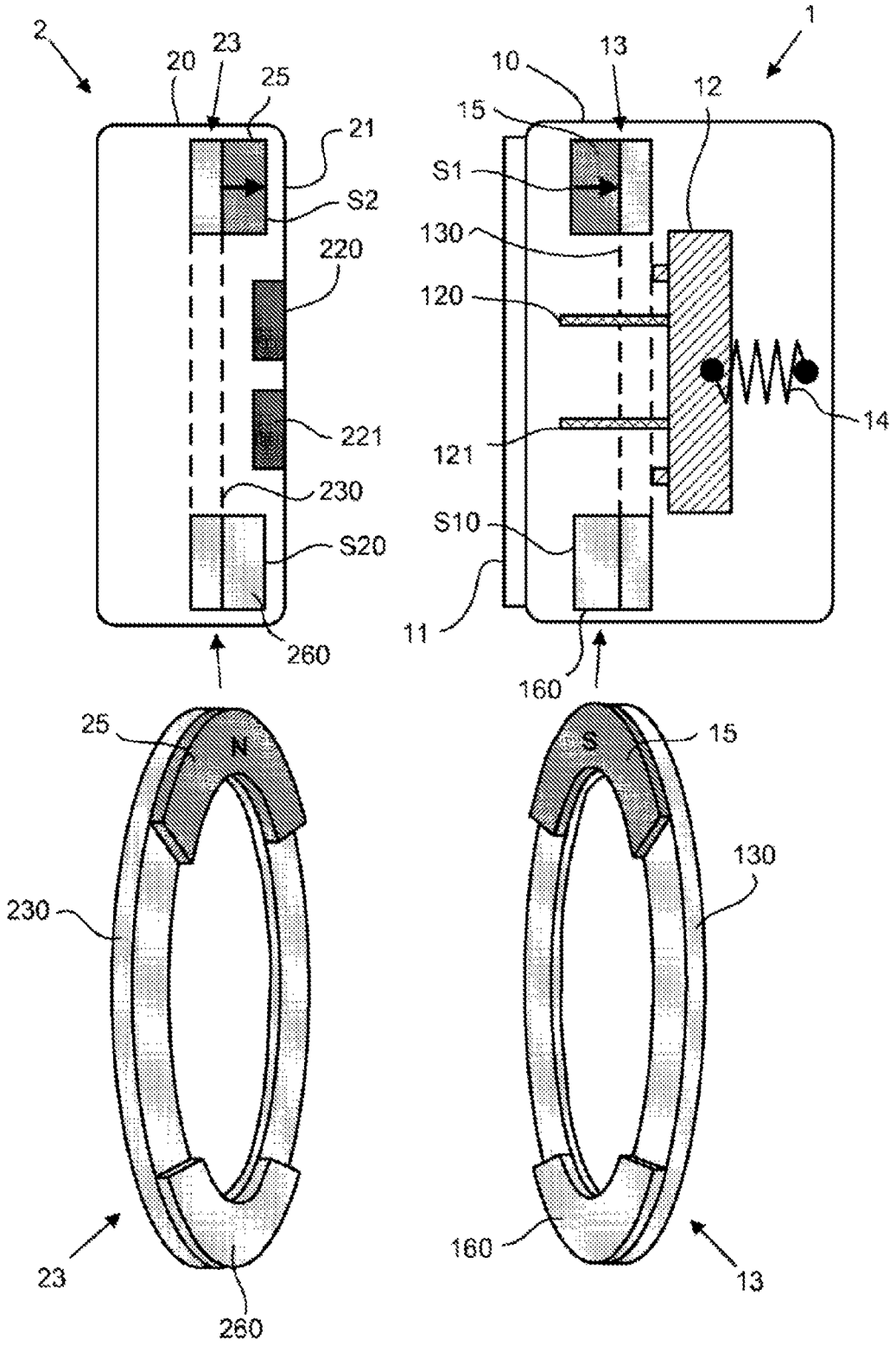
FIGS. 3A and 3B represent a third architecture of the electrical connector assembly of the invention, comprising a socket and a plug respectively uncoupled and coupled.
Figure 3B:
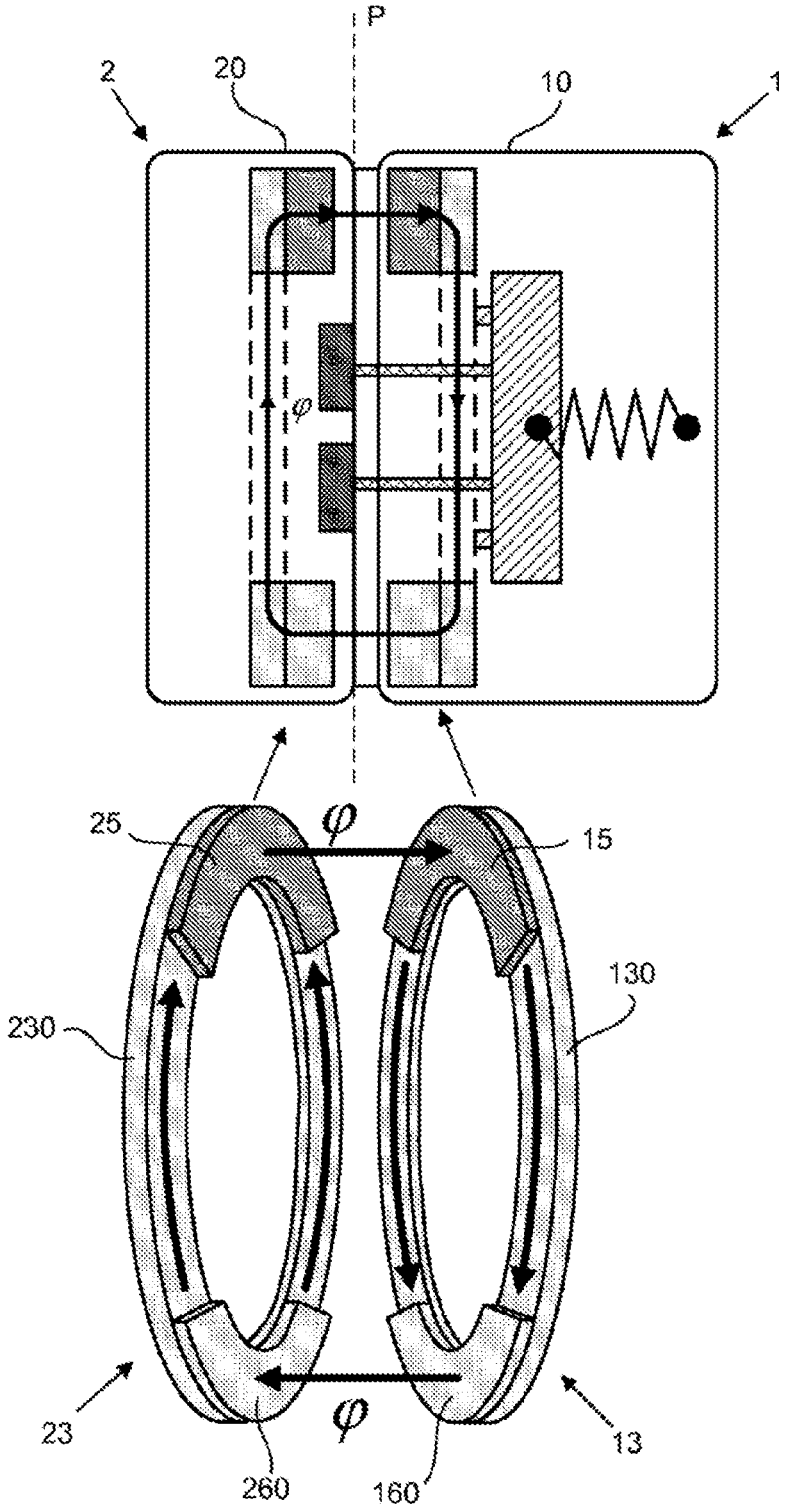

Third Architecture—FIGS. 3A and 3B

In this third architecture, the second magnetic part 23 is identical to that of the first architecture described hereinabove. The first magnetic part 13 present in the socket 1 in fact comprises a permanent magnet 15 fixed on one of its annular portions defined hereinabove so as to form the first air-gap surface S1 situated opposite that produced by the permanent magnet 25 of the second magnetic part 23. In the first magnetic part 13, the second air-gap surface S10 is produced by virtue of an element 160 made of magnetic material.

In this architecture, the two ferromagnetic pieces 130, 230 of annular shape are of identical size.

This architecture exhibits the advantage of allowing automatic centering of the plug 2 on the socket 1, by virtue of the two permanent magnets 15, 25 distributed in the socket 1 and the plug 2.

In this architecture, the magnetic flux generated follows the same path as in the first architecture.

Figure 4A:
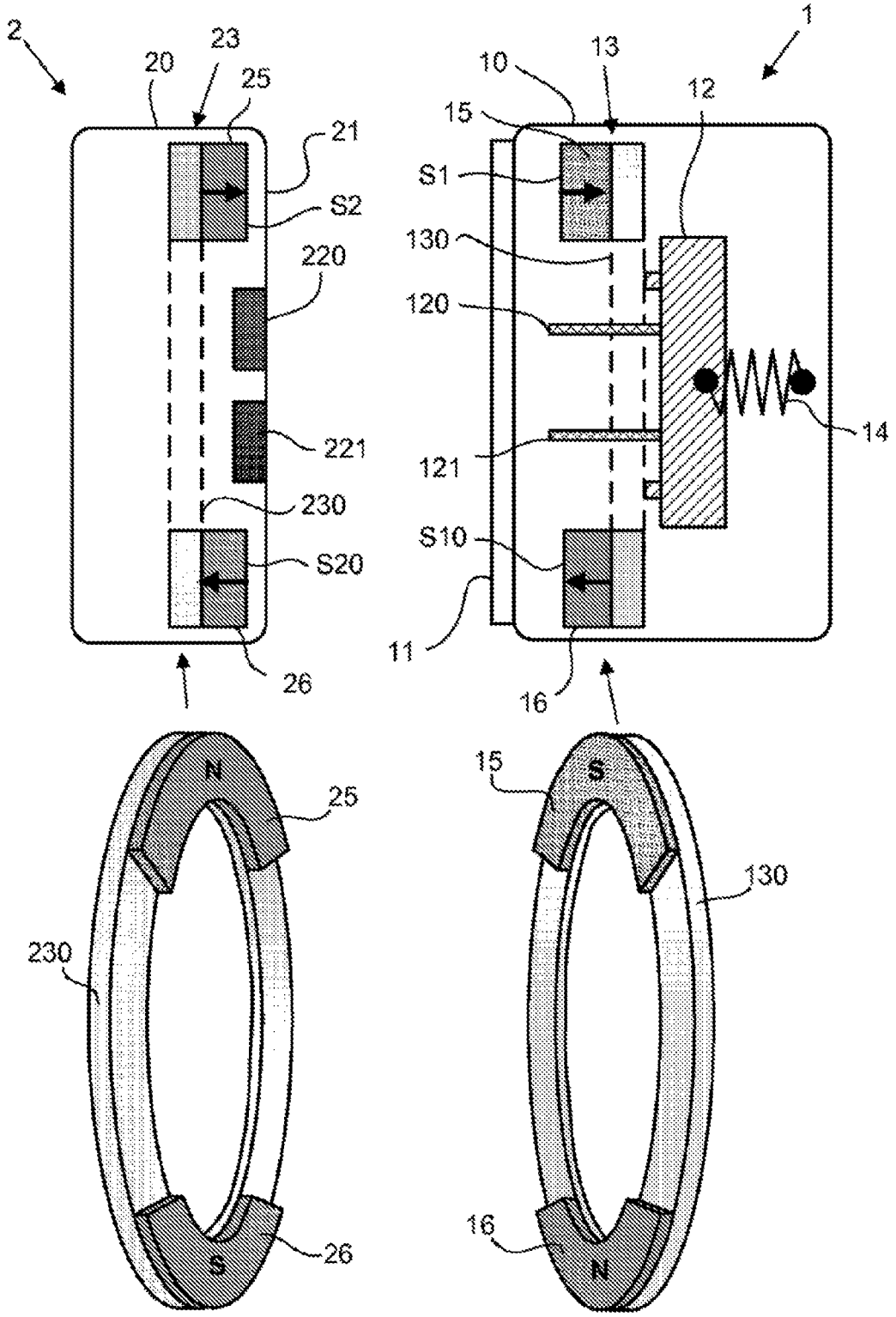
FIGS. 4A and 4B represent a fourth architecture of the electrical connector assembly of the invention, comprising a socket and a plug respectively uncoupled and coupled.
Figure 4B:
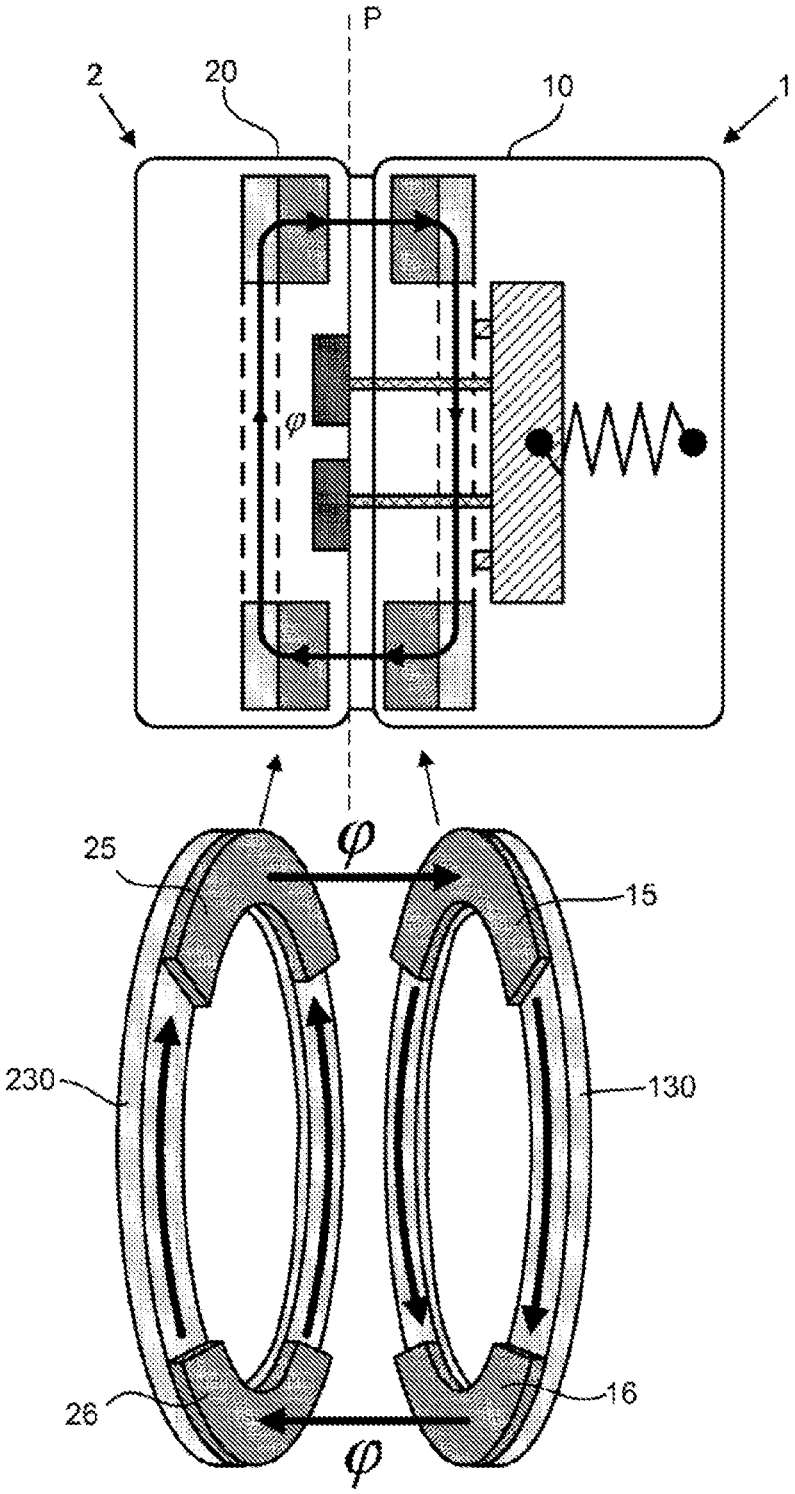

Fourth Architecture—FIGS. 4A and 4B

In this architecture, the two annular portions of the first ferromagnetic piece 13 are each occupied by a permanent magnet 15, 16 and the two annular portions of the second ferromagnetic piece are each also occupied by a permanent magnet 25, 26, thus forming pairwise the two air-gaps of the magnetic circuit when the plug 2 is brought closer to the socket 1.

This configuration exhibits the advantage of efficacious self-centering and of a balanced magnetic force, the four magnets 15, 16, 25, 26 being distributed in a symmetric manner when the plug is brought closer to the socket.

In this architecture, the two ferromagnetic pieces 130, 230 of annular shape are of identical sizes.

In this architecture, the magnetic flux generated follows the same path as in the first architecture.

Figure 5:
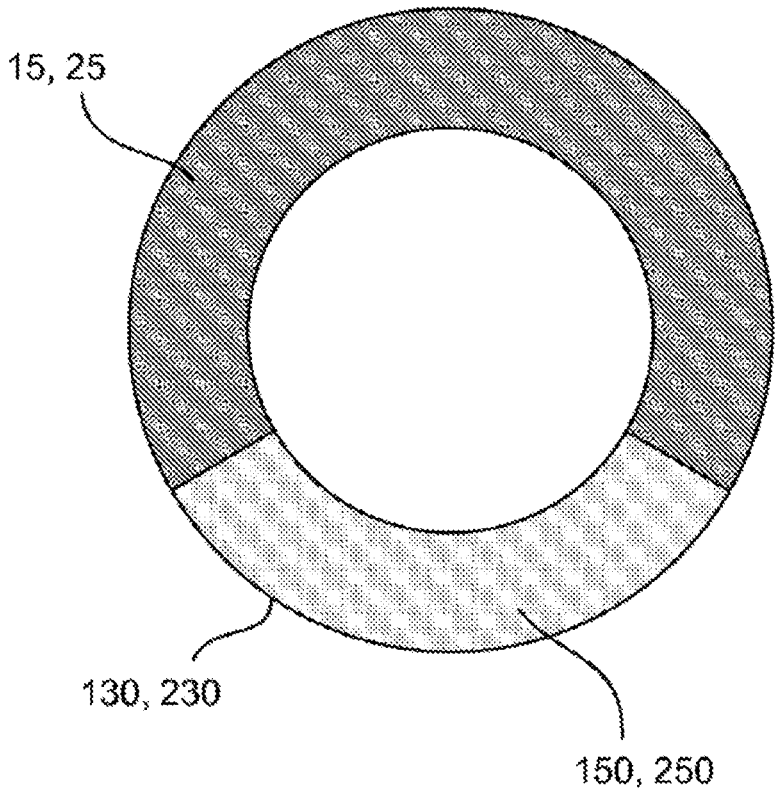
FIG. 5 represents a variant embodiment of a magnetic part employed.

As an embodiment variant, as represented in FIG. 5, it is possible to increase the size of each permanent magnet and to extend the overlaid annular portion so as to better center the magnetic force exerted.

The various architectures described thus exhibit numerous advantages, among which:

the generation of a magnetic force dedicated entirely to the extraction of the electrical contacts, the magnetic field lines being absorbed in the magnetic circuit generated and not dispersed in the air, when both the socket and the plug comprise a permanent magnet, the possibility of obtaining automatic self-centering of the connector on the socket, when a magnetic part comprises two permanent magnets positioned in a symmetric manner, the magnetic force exerted is balanced, the generation of a magnetic circuit around the electrical connection facility, making it possible to ensure better mechanical fastening and thus better electrical connection.

The invention claimed is:

1. An apparatus comprising an electrical connector assembly, the electrical connector assembly comprising a socket and a plug, wherein the socket comprises at least one first electrical contact and a first magnetic part integral in motion with the first electrical contact, the first magnetic part being arranged to move by magnetic effect between first and second positions, wherein, in the first position, the first electrical contact is retracted inside the socket and wherein in the second position the first electrical contact is outside the socket, wherein the plug fits into the socket and includes at least one second electrical contact that connects electrically to the first electrical contact when the latter is outside the socket and a second magnetic part arranged opposite the first magnetic part when the plug is fitted on the socket so as to displace, by magnetic effect, the first magnetic part toward its second position, driving the first electrical contact outward from the socket, wherein one of the first and second magnetic parts comprises at least one permanent magnet in such a way as to form a magnetic circuit when the plug is brought closer to the socket, wherein the first magnetic part comprises a first air-gap surface and a second air-gap surface and a first ferromagnetic piece fixed on the one hand on a surface opposite to its first air-gap surface and on the other hand on a surface opposite to its second air-gap surface, wherein the second magnetic part comprises a first air-gap surface intended to be opposite the first air-gap surface of the first magnetic part so as to form a first air-gap, a second air-gap surface intended to be opposite the second air-gap surface of the first magnetic part so as to form a second air-gap when the plug is brought closer to the socket and a second ferromagnetic piece fixed on the one hand on a surface opposite to its first air-gap surface and on the other hand on a surface opposite to its second air-gap surface, wherein the magnetic circuit is formed between the first magnetic part and the second magnetic part so as to generate a magnetic flux that passes through the first air gap in a first direction and that passes through the second air gap in a second direction that is opposite said first direction.

2. The apparatus of claim 1, wherein the first ferromagnetic piece has a loop-shaped architecture arranged parallel to the junction plane and wherein the second ferromagnetic piece has an architecture identical to that of the first ferromagnetic piece.

3. The apparatus of claim one of claim 1, wherein the plug further comprises a casing and wherein the second magnetic part is arranged to rotate freely inside the casing.

4. The apparatus of claim 1, wherein the first and second magnetic parts are arranged such that the magnetic circuit generates a magnetic flux surrounding the first electrical contacts and the second electrical contacts.

5. The apparatus of claim 1, wherein the first ferromagnetic piece is annular and arranged parallel to the junction plane and wherein the second ferromagnetic piece is annular and arranged parallel to the junction plane.

6. The apparatus of claim 5, wherein the permanent magnet is fixed on a first annular portion of the second ferromagnetic piece and forms the first air-gap surface of the second magnetic part.

7. The apparatus of claim 6, further comprising first, second, and third elements, all of which are made of ferromagnetic material, wherein the first element is fixed on a second annular portion symmetrically with the permanent magnet in such a way as to form the second air-gap surface of the second magnetic part and wherein the second and third elements are fixed symmetrically on two annular portions of the first ferromagnetic piece to form the first air-gap surface and the second air-gap surface of the first magnetic part.

8. The apparatus of claim 6, further comprising a permanent magnet and first and second elements made of ferromagnetic material, wherein the permanent magnet is fixed on a second annular portion of the second ferromagnetic piece and forms the second air-gap surface of the second magnetic part, and wherein the first and second elements are fixed symmetrically on two annular portions of the first ferromagnetic piece to form the first air-gap surface and the second air-gap surface of the first magnetic part.

9. The apparatus of claim 6, further comprising first, second, and third permanent magnets, wherein the first permanent magnet is fixed on a second annular portion of the second ferromagnetic piece and forms the second air-gap surface of the second magnetic part, and wherein the second and third permanent magnets are fixed symmetrically on two annular portions of the first ferromagnetic piece to form the first air-gap surface and the second air-gap surface of the first magnetic part.

10. The apparatus of claim 6, further comprising a permanent magnet and first and second elements made of ferromagnetic material, wherein the first element is fixed on a second annular portion symmetrically with the permanent magnet, in such a way as to form the second air-gap surface of the second magnetic part, wherein the permanent magnet is fixed on a first annular portion of the first ferromagnetic piece forming the first air-gap surface of the first magnetic part, and wherein the second element is fixed on a second annular portion of the first ferromagnetic piece, symmetrically with the permanent magnet, in such a way as to form the second air-gap surface of the first magnetic part.

11. The apparatus of claim 5, wherein the permanent magnet is fixed on a first annular portion of the first ferromagnetic piece to form the first air-gap surface of the first magnetic part.

12. The apparatus of claim 11, further comprising first, second, and third elements made of ferromagnetic material, wherein the first element is fixed on a second annular portion of the first ferromagnetic piece, symmetrically with the permanent magnet, in such a way as to form the second air-gap surface of the first magnetic part and wherein the second and third elements are fixed symmetrically on two annular portions of the second ferromagnetic piece, forming the first air-gap surface and the second air-gap surface of the second magnetic part.

13. The apparatus of claim 11, further comprising a permanent magnet and first and second elements made of ferromagnetic material, wherein the permanent magnet is fixed on a second annular portion of the first ferromagnetic piece to form the second air-gap surface of the first magnetic part and wherein the first and second elements are fixed symmetrically on two annular portions of the second ferromagnetic piece to form the first air-gap surface and the second air-gap surface of the second magnetic part.

14. The apparatus of claim 11, further comprising first, second, and third permanent magnets, wherein the first permanent magnet is on a second annular portion of the first ferromagnetic piece to form the second air-gap surface of the first magnetic part and wherein the second and third permanent magnets are fixed symmetrically on two annular portions of the second ferromagnetic piece thus forming the first air-gap surface and the second air-gap surface of the second magnetic part.

* * * * *